US007956007B2

(12) United States Patent
Ishibashi et al.

(10) Patent No.: US 7,956,007 B2
(45) Date of Patent: Jun. 7, 2011

(54) HEAT-SENSITIVE RECORDING MATERIAL

(75) Inventors: Yoshimi Ishibashi, Amagasaki (JP); Yukie Mori, Amagasaki (JP)

(73) Assignee: Oji Paper Co., Ltd., Tokyo (JP)

( * ) Notice: Subject to any disclaimer, the term of this patent is extended or adjusted under 35 U.S.C. 154(b) by 981 days.

(21) Appl. No.: 11/883,175

(22) PCT Filed: Jan. 24, 2006

(86) PCT No.: PCT/JP2006/301021

§ 371 (c)(1),
(2), (4) Date: Jul. 27, 2007

(87) PCT Pub. No.: WO2006/080293

PCT Pub. Date: Aug. 3, 2006

(65) Prior Publication Data

US 2008/0167184 A1 Jul. 10, 2008

(30) Foreign Application Priority Data

Jan. 28, 2005 (JP) ..... 2005-020782

(51) Int. Cl.
*B41M 5/333* (2006.01)
*B41M 5/337* (2006.01)

(52) U.S. Cl. ..... 503/209; 503/216; 503/226

(58) Field of Classification Search ..... None
See application file for complete search history.

(56) References Cited

U.S. PATENT DOCUMENTS

| | | | | |
|---|---|---|---|---|
| 5,200,385 | A | 4/1993 | Inoue et al. | 503/209 |
| 6,486,094 | B1 * | 11/2002 | Shirai et al. | 503/216 |
| 6,677,472 | B2 * | 1/2004 | Shirai et al. | 560/12 |
| 6,852,671 | B2 * | 2/2005 | Iwasaki et al. | 503/216 |
| 2003/0186810 | A1 | 10/2003 | Kato et al. | 503/216 |

FOREIGN PATENT DOCUMENTS

| | | | |
|---|---|---|---|
| EP | 1 044 824 | A2 | 10/2000 |
| EP | 1 264 707 | A2 | 12/2002 |
| JP | 2000-355578 | A | 12/2000 |
| JP | 2001-310561 | A | 11/2001 |
| JP | 2002-52842 | A | 2/2002 |
| JP | 2002-283741 | A | 10/2002 |
| JP | 2003-89273 | A | 3/2003 |
| JP | 2004-9593 | A | 1/2004 |
| JP | 2004-130539 | A | 4/2004 |
| JP | 2004-195747 | A | 7/2004 |
| JP | 2004-237476 | A | 8/2004 |
| JP | 2004-255842 | A | 9/2004 |
| JP | 2005-104134 | A | 4/2005 |

* cited by examiner

*Primary Examiner* — Bruce H Hess
(74) *Attorney, Agent, or Firm* — Kubovcik & Kubovcik

(57) ABSTRACT

A heat-sensitive recording material comprising a support and a heat-sensitive recording layer, the heat-sensitive recording layer comprising a colorless or pale-colored basic dye and a developer, the developer being 4-allyloxy-4'-hydroxydiphenylsulfone, and the heat-sensitive recording layer further comprising a compound represented by formula (I):

(I)

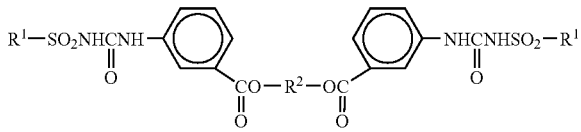

wherein $R^1$ is an unsubstituted aromatic group, or an aromatic group substituted with at least one member selected from the group consisting of a methyl group and a chlorine atom, and $R^2$ is a divalent organic group.

13 Claims, No Drawings

HEAT-SENSITIVE RECORDING MATERIAL

This application is a 371 of international application PCT/JP2006/301021 filed Jan. 24, 2006, which claims priority based on Japanese patent application No. 2005-20782 filed Jan. 28, 2005, which is incorporated herein by reference.

TECHNICAL FIELD

The present invention relates to a heat-sensitive recording material using the color-forming reaction between a developer and a colorless or pale-colored basic dye, and more particularly to a heat-sensitive recording material having thermal resistance while exhibiting excellent recording sensitivity and recorded-image preservability.

BACKGROUND ART

Heat-sensitive recording materials are well-known which utilize the color-forming reaction between a colorless or pale-colored leuco dye and an organic or inorganic developer, such that the two chromogenic materials are brought into contact with each other by heating to thereby produce a recorded image. Such heat-sensitive recording materials are relatively inexpensive, and the recording apparatuses therefor are compact and easy to maintain. For these reasons, heat-sensitive recording materials are used not only as recording media for facsimiles and a variety of computers, but also have found a wide range of uses.

Examples of such uses include cash register receipts for POS (point-of-sale) systems, paper for various tickets, etc. With the expansion of POS systems, the uses and usage environments of heat-sensitive recording materials have diversified, and their use under difficult conditions is increasing. Moreover, the printing speed of printers is increasing year by year, so that a demand exists for heat-sensitive recording materials that can record at lower energy. In addition, because heat-sensitive recording materials are also used as receipts, the recorded portions need to exhibit good seal ability and preservability against oils, plasticizers, office stationery, hand creams and the like.

The color-forming reaction in heat-sensitive recording materials comprising, over a support, a heat-sensitive coloring layer principally composed of a leuco dye and a developer is reversible, and therefore the recorded images are known to lose color with time. Such color fading is accelerated by exposure to light, high temperatures, and high-humidity atmospheres, and also proceeds rapidly when in contact with plasticizers, oils and the like, to such an extent that the recorded images become illegible. Furthermore, when such heat-sensitive recording materials are used as paper for parking tickets, they are left in cars, under a severe high-temperature atmosphere especially during summertime, so that the background of the heat-sensitive recording materials becomes colored and loses contrast with the recorded portions (recorded images), and in some extreme cases, the recorded images become illegible.

In order to overcome these problems, methods for improving the preservability of recorded images have been suggested, for example, by forming a protective layer on a heat-sensitive coloring layer, or by adding an epoxy compound to a heat-sensitive coloring layer. None of these methods, however, have yet to provide sufficient improvements in the preservability of recorded images against oils, plasticizers and the like. Providing a protective layer also has a drawback in that the sensitivity is lowered. Moreover, although the problems of color fading by exposure to light, high temperatures and high-humidity atmospheres, and lowered contrast at high temperatures are about to be solved owing to the recent advent of developers providing high recorded-image preservability, the drawback of low recording sensitivity still remains.

The use of 4-allyloxy-4'-hydroxydiphenylsulfone as a developer or a component of a developer is disclosed (see Patent Document 1), and developers that are used together with this developer are also disclosed, such as oligomer-type developers (see Patent Document 2), 4,4'-dihydroxydiphenylsulfone (see Patent Document 3), and 2,4'-dihydroxydiphenylsulfone (see Patent Document 4). Other heat-sensitive recording materials are also disclosed which comprise, in addition to 4-allyloxy-4'-hydroxydiphenylsulfone, an urea-urethane-based compound (see Patent Document 5), p-acetylbiphenyl as a specific sensitizer (see Patent Document 6), or a methylated methylol melamine condensate as a specific preservability improving agent (see Patent Document 7). Furthermore, a heat-sensitive recording material is disclosed which comprises, in addition to 4-allyloxy-4'-hydroxydiphenylsulfone, a dye, a developer, and various preservation stabilizers (see Patent Document 8), or a heat-sensitive recording material which comprises a specific compound without using 4-allyloxy-4'-hydroxydiphenylsulfone (see Patent Document 9). None of these heat-sensitive recording materials, however, have provided satisfactory properties with respect to heat resistance, recording sensitivity and recorded-image preservability.

Patent Document 1: Japanese Unexamined Patent Application Publication No. 2001-310561

Patent Document 2: Japanese Unexamined Patent Application Publication No. 2002-283741

Patent Document 3: Japanese Unexamined Patent Application Publication No. 2004-130539

Patent Document 4: Japanese Unexamined Patent Application Publication No. 2004-195747

Patent Document 5: Japanese Unexamined Patent Application Publication No. 2004-255842

Patent Document 6: Japanese Unexamined Patent Application Publication No. 2002-052842

Patent Document 7: Japanese Unexamined Patent Application Publication No. 2004-237476

Patent Document 8: Japanese Unexamined Patent Application Publication No. 2004-009593

Patent Document 9: Japanese Unexamined Patent Application Publication No. 2005-104134

DISCLOSURE OF THE INVENTION

Problem to be Solved by the Invention

An object of the present invention is to provide a heat-sensitive recording material having heat resistance while exhibiting excellent recording sensitivity and recorded-image preservability.

Means for Solving the Problem

The present inventors conducted extensive research in order to accomplish the aforementioned object. As a result, the following findings were obtained:

(a) Although the use of 4-allyloxy-4'-hydroxydiphenylsulfone as a developer in a heat-sensitive recording layer imparted heat resistance, this resulted in a substantial deterioration in the recorded-image preservability.

(b) For this reason, when 4-allyloxy-4'-hydroxydiphenylsulfone was used as a developer, a developer and a an agent to improve preservability for use in combination with 4-allyloxy-4'-hydroxydiphenylsulfone, as in the aforementioned prior art, were selected in order to improve heat resistance, recording sensitivity and recorded-image preservability; however, a heat-sensitive recording material of satisfactory quality was not obtained.

(c) As a result of further research, however, it was found that the addition of a specific compound in a heat-sensitive recording layer improves preservability and recording sensitivity without substantial loss of the heat resistance inherently achieved by 4-allyloxy-4'-hydroxydiphenylsulfone used as a developer.

The present invention has been accomplished by conducting further study based on these findings, and provides heat-sensitive recording materials as set forth below:

Item 1: A heat-sensitive recording material comprising a support and a heat-sensitive recording layer; the heat-sensitive recording layer comprising a colorless or pale-colored basic dye, a developer and a binder; the developer being 4-allyloxy-4'-hydroxydiphenylsulfone; and the heat-sensitive recording layer further comprising a compound represented by formula (I):

[Chemical formula 1]

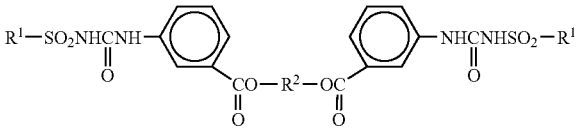

(I)

wherein $R^1$ is an unsubstituted aromatic group, or an aromatic group substituted with at least one member selected from the group consisting of methyl groups and a chlorine atom, and $R^2$ is a divalent organic group.

Item 2: A heat-sensitive recording material according to Item 1, wherein $R^1$ is unsubstituted phenyl or unsubstituted naphthyl, or phenyl or naphthyl substituted with one or two members selected from the group consisting of a methyl group and a chlorine atom; and $R^2$ is (a): a straight $C_{1-30}$ alkylene group, a branched $C_{1-30}$ alkylene group, a $C_{6-16}$ cycloalkylene group, or a $C_{1-4}$ alkylene group containing the cycloalkylene group within the structure; or (b): a group represented by the formula —$(CH_2CH_2X)n$-$CH_2CH_2$— (wherein X is an oxygen or sulfur atom, and n is an integer from 1 to 20), 2,5-(1-oxacyclohexylene) group, or 1-oxacyclohexane-2,5-dimethylene group.

Item 3: A heat-sensitive recording material according to Item 1 or 2, wherein $R^2$ is a —$(CH_2)m$- group or a —$(CH_2CH_2O)n$-$CH_2CH_2$— group, wherein m is an integer from 1 to 30, and n is an integer from 1 to 20.

Item 4: A heat-sensitive recording material according to Item 1, wherein the compound represented by formula (I) is a compound represented by formula (II):

[Chemical formula 2]

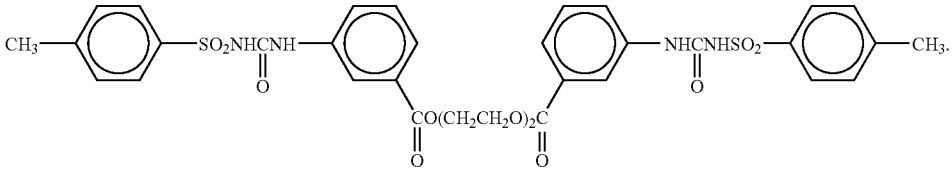

(II)

Item 5: A heat-sensitive recording material according to Item 1, wherein the compound represented by formula (I) is a compound represented by formula (III):

[Formula 3]

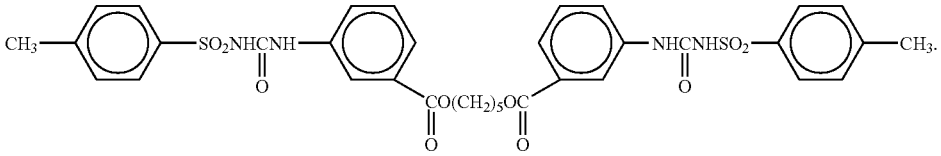

(III)

Item 6: A heat-sensitive recording material according to Item 1, wherein the compound represented by formula (I) is a compound represented by formula (IV):

[Chemical formula 4]

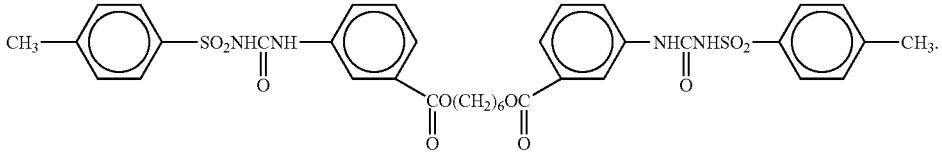

(IV)

Item 7: A heat-sensitive recording material according to any of Items 1 to 6, wherein the heat-sensitive recording layer further comprises an inorganic acidic material, a phenolic compound, a thiourea compound, an organic compound having an —$SO_2NH$— bond in the molecular, an aromatic carboxylic acid, a polyvalent metal salt of an aromatic carboxylic acid, an antipyrin complex of zinc thiocyanate, a composite zinc salt of terephthalaldehydic acid with another aromatic carboxylic acid, or a mixture thereof.

Item 8: A heat-sensitive recording material according to any of Items 1 to 7, wherein the heat-sensitive recording layer further comprises a sensitizer, a preservability-improving agent, or a mixture thereof.

Item 9: A heat-sensitive recording material according to any of Items 1 to 8, further comprising a protective layer on the heat-sensitive recording layer.

Item 10: A heat-sensitive recording material according to Item 9, wherein the protective layer comprises a binder, or a binder and a pigment.

Item 11: A heat-sensitive recording material according to Item 9 or 10, wherein the protective layer further comprises microcapsules encapsulating an ultraviolet absorbent that is liquid at ordinary temperatures; the microcapsules being present in such an amount that the proportion of the ultraviolet light absorber is from 10 to 40 mass % relative to total solids of the protective layer.

Item 12: A heat-sensitive recording material according to Item 1, wherein the support comprises recycled pulp.

Item 13: A heat-sensitive recording material according to any of Items 1 to 12, further comprising an undercoat layer between the support and the heat-sensitive recording layer.

EFFECTS OF THE INVENTION

The heat-sensitive recording material according to the present invention has heat resistance while exhibiting excellent recording sensitivity and recorded-image preservability.

The heat-sensitive recording material of the invention, even when comprising a support containing recycled pulp, exhibits excellent recorded-image preservability without deterioration.

Moreover, the heat-sensitive recording material of the invention, even when recording after a long period of storage in a blank state (i.e. unrecorded state), gives a color density substantially equal to that before storage.

BEST MODE FOR CARRYING OUT THE INVENTION

As described above, the heat-sensitive recording material of the invention comprises a support and a heat-sensitive recording layer comprising a colorless or pale-colored basic dye, a developer and a binder, wherein the developer is 4-allyloxy-4'-hydroxydiphenylsulfone, and the heat-sensitive recording layer further comprises a compound represented by general formula (I) shown above.

Compound Represented by General Formula (I)

The addition of a compound represented by formula (I) shown below into a heat-sensitive recording layer improves preservability and recording sensitivity without substantial loss of the heat resistance inherently achieved by 4-allyloxy-4'-hydroxydiphenylsulfone used as a developer:

[Chemical formula 5]

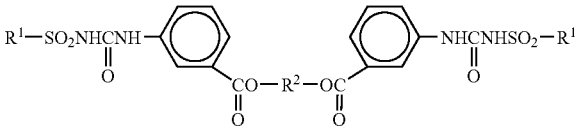

(I)

wherein $R^1$ is an unsubstituted aromatic group, or an aromatic group substituted with at least one member selected from the group consisting of a methyl group and a chlorine atom; and $R^2$ is a divalent organic group.

The $R^1$ group in formula (I) is an unsubstituted aromatic group (for example, a phenyl or naphthyl group), or an aromatic group (for example, a phenyl or naphthyl group) substituted with at least one member (preferably one or two members) selected from the group consisting of a methyl group and a chlorine atom. Particularly, the $R^1$ group is an unsubstituted phenyl group or an unsubstituted naphthyl group, or a phenyl group substituted with one methyl group or chlorine atom. Specific examples of the $R^1$ group include phenyl, 2-naphthyl, p-tolyl, o-tolyl, m-tolyl, p-chlorophenyl and the like.

While the $R^2$ group in formula (I) is not limited as long as it is a divalent organic group, it is preferably a member selected from groups (a) and (b) shown below.

(a) Divalent groups formed by the removal of two hydrogen atoms from an straight or cyclic aliphatic hydrocarbon, and particularly, —$(CH_2)$m- group, wherein m is an integer from 1 to 30, particularly 1 to 15, and preferably 1 to 10.

Specific examples include $C_{1-30}$, particularly $C_{1-15}$, and preferably $C_{1-10}$, straight alkylene groups such as methylene, dimethylene, trimethylene, tetramethylene, pentamethylene and hexamethylene groups; and $C_{1-30}$, and particularly $C_{18}$, branched alkylene groups such as 1-methyl-1,3-trimethylene and 2,3-dimethyl-1,4-tetramethylene groups; and $C_{6-16}$, and preferably $C_{6-10}$, cycloalkylene groups, as well as $C_{1-4}$ alkylene groups containing the cycloalkylene group within the structure such as 1,4-cyclohexylene and 1,4-cyclohexanedimethylene groups.

(b) Divalent groups formed by the removal of two hydrogen atoms from a compound resulting from the partial substitution of an straight or cyclic aliphatic hydrocarbon by hetero atom(s) (e.g., oxygen or sulfur atom), and particularly, groups represented by the formula —$(CH_2CH_2X)n$-$CH_2CH_2$—, wherein X is an oxygen or sulfur atom, and n is an integer from 1 to 20, preferably 1 to 10, and more preferably 1 to 5.

Specific examples include 1,5-(3-oxapentamethylene) group (—$CH_2CH_2$—O—$CH_2CH_2$—); 1,5-(3-thiopentamethylene) group (—$CH_2CH_2$—S—$CH_2CH_2$—); 1,8-(3,6-dioxaoctylene) group (—$CH_2CH_2$—O—$CH_2CH_2$—O—$CH_2CH_2$—); 2,5-(1-oxacyclohexylene) group represented by formula (1) shown below; and 1-oxacyclohexane-2,5-dimethylene group represented by formula (2) shown below:

[Chemical formula 6]

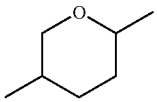

(1)

-continued

[Chemical formula 7]

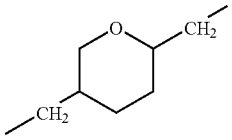

(2)

In formula (I) shown above, the divalent organic group represented by $R^2$ is preferably a —$(CH_2)$m- group or a —$(CH_2CH_2O)$n-$CH_2CH_2$— group, wherein m is an integer from 1 to 30, particularly 1 to 15, and preferably 1 to 10, or n is an integer from 1 to 20, particularly 1 to 10, and preferably 1 to 5.

Among the compounds represented by formula (I), the compound represented by formula (II) shown below is preferred, because it provides excellent recording sensitivity and recorded-image preservability:

[Chemical formula 8]

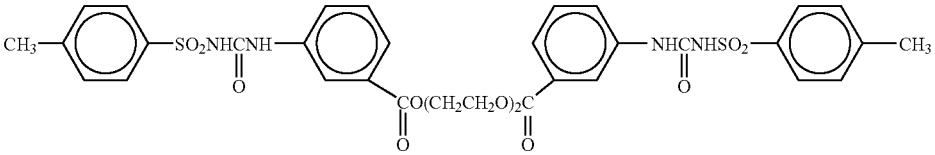

(II)

Similarly, the compound represented by formula (III) shown below is preferred among the compounds represented by formula (I), because it provides excellent recording sensitivity and recorded-image preservability:

[Chemical formula 9]

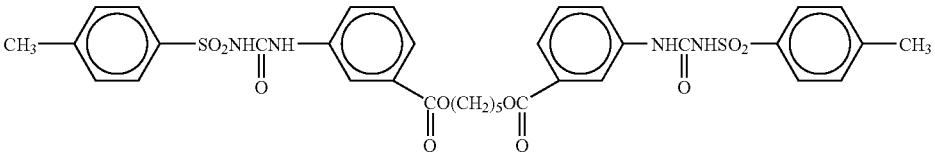

(III)

Similarly, the compound represented by formula (IV) shown below is preferred among the compounds represented by formula (I), because it provides excellent recording sensitivity and recorded-image preservability:

[Chemical formula 10]

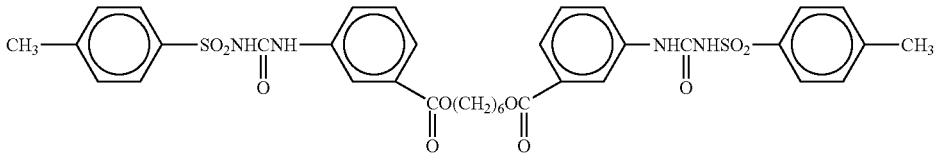

(IV)

In addition to the preferred compounds represented by formulae (II), (III) and (IV), typical examples of compounds represented by formula (I) according to the invention for use in combination with the developer 4-allyloxy-4'-hydroxydiphenylsulfone include the following:

methylene bis(3-(3-(p-toluenesulfonyl)ureido)benzoate);

methylene bis(3-(3-(m-toluenesulfonyl)ureido)benzoate);

methylene bis(3-(3-(o-toluenesulfonyl)ureido)benzoate);

1,2-dimethylene bis(3-(3-(p-toluenesulfonyl)ureido)benzoate);

1,2-dimethylene bis(3-(3-(m-toluenesulfonyl)ureido)benzoate);

1,2-dimethylene bis(3-(3-(o-toluenesulfonyl)ureido)benzoate);

1,3-trimethylene bis(3-(3-(p-toluenesulfonyl)ureido)benzoate);

1,3-trimethylene bis(3-(3-(o-toluenesulfonyl)ureido)benzoate);

1,3-trimethylene bis(3-(3-(m-toluenesulfonyl)ureido)benzoate);

1,4-tetramethylene bis(3-(3-(p-toluenesulfonyl)ureido)benzoate);

1,4-tetramethylene bis(3-(3-(o-toluenesulfonyl)ureido)benzoate);

1,4-tetramethylene bis(3-(3-(m-toluenesulfonyl)ureido)benzoate);

1,5-pentamethylene bis(3-(3-(m-toluenesulfonyl)ureido)benzoate);

1,5-pentamethylene bis(3-(3-(o-toluenesulfonyl)ureido)benzoate);

1,6-hexamethylene bis(3-(3-(m-toluenesulfonyl)ureido)benzoate);

1,6-hexamethylene bis(3-(3-(o-toluenesulfonyl)ureido)benzoate);

1,7-heptamethylene bis(3-(3-(p-toluenesulfonyl)ureido)benzoate);

1,7-heptamethylene bis(3-(3-(m-toluenesulfonyl)ureido)benzoate);

1,7-heptamethylene bis(3-(3-(o-toluenesulfonyl)ureido)benzoate);

1,8-octamethylene bis(3-(3-(p-toluenesulfonyl)ureido)benzoate);

1,8-octamethylene bis(3-(3-(m-toluenesulfonyl)ureido)benzoate);

1,8-octamethylene bis(3-(3-(o-toluenesulfonyl)ureido)benzoate);

1,9-nonamethylene bis(3-(3-(p-toluenesulfonyl)ureido)benzoate);

1,9-nonamethylene bis(3-(3-(m-toluenesulfonyl)ureido)benzoate);

1,9-nonamethylene bis(3-(3-(o-toluenesulfonyl)ureido)benzoate);

1-methylethylene bis(3-(3-(p-toluenesulfonyl)ureido)benzoate);

1-methylethylene bis(3-(3-(o-toluenesulfonyl)ureido)benzoate);

1-methylethylene bis(3-(3-(m-toluenesulfonyl)ureido)benzoate);

1,5-(3-oxapentamethylene) bis(3-(3-(m-toluenesulfonyl)ureido) benzoate);

1,8-(3,6-dioxaoctylene) bis(3-(3-(p-toluenesulfonyl)ureido) benzoate);

1,8-(3,6-dioxaoctylene) bis(3-(3-(m-toluenesulfonyl)ureido) benzoate); and 1,8-(3,6-dioxaoctylene) bis(3-(3-(o-toluenesulfonyl)ureido) benzoate).

All of the compounds represented by formula (I) and formulae (II) to (IV) can be synthesized by a known process, such as the process disclosed in the Examples of Japanese Patent Application No. 2004-242569 (see Preparation Examples 1 and 2 mentioned below).

In the heat-sensitive recording layer, the content of the compound represented by formula (I) for use in the invention is not limited, and may suitably be selected according to the basic dye used; but typically, it is preferably from about 0.1 to about 2 mass parts, and more preferably from about 0.2 to about 1 mass part, per mass part of the basic dye. Within the range of about 0.1 to about 2 mass parts, the recorded-image durability and the recording sensitivity are satisfactory.

Developer

The developer for use in the invention is 4-allyloxy-4'-hydroxydiphenylsulfone. This compound is a developer well known in the art of heat-sensitive recording materials.

The amount of 4-allyloxy-4'-hydroxydiphenylsulfone used is not limited, and may suitably be selected according to the basic dye, sensitizer, or other components used; but typically, it is preferably from about 1 to about 5 mass parts, and more preferably from about 1.5 to about 3 mass parts, per mass part of the basic dye.

Although the developer for use in the invention is 4-allyloxy-4'-hydroxydiphenylsulfone, various types of known materials can optionally be used together with 4-allyloxy-4'-hydroxydiphenylsulfone, as long as the effects of the invention are not impaired. Examples of such materials include activated clay, attapulgite, colloidal silica, aluminum silicate, and like inorganic acid materials;

4,4'-isopropylidenediphenol, 1,1-bis(4-hydroxyphenyl)-1-phenylethane, 1,1-bis(4-hydroxyphenyl)cyclohexane, 2,2-bis(4-hydroxyphenyl)-4-methylpentane, 2,4'-dihydroxydiphenylsulfone, 4,4'-bis[(4-methyl-3-phenoxycarbonylaminophenyl)ureido] diphenylsulfone, N-p-toluenesulfonyl-N'-3-(p-toluenesulfonyloxy)phenylurea, 4,4'-dihydroxydiphenylsulfide,
hydroquinonemonobenzyl ether;
4-benzyl hydroxybenzoate, 4,4'-dihydroxydiphenylsulfone,
4-hydroxy-4'-isopropoxydiphenylsulfone,
bis(3-allyl-4-hydroxyphenyl)sulfone,
4-hydroxy-4'-methyldiphenylsulfone,
4-hydroxyphenyl-4'-benzyloxyphenylsulfone,
3,4-dihydroxyphenyl-4'-methylphenylsulfone, and
like phenolic compounds;
N,N'-di-m-chlorophenylthiourea and like thiourea compounds;
N-(p-toluenesulfonyl) carbamoyl acid p-cumylphenyl ester,
N-(p-toluenesulfonyl) carbamoyl acid p-benzyloxyphenyl ester,
N-(o-toluoyl)-p-toluenesulfonylamide,
N-(p-toluenesulfonyl)-N'-(p-tolyl)urea and like organic compounds having an —$SO_2$NH— bond;
p-chlorobenzoic acid, 4-[2-(p-methoxyphenoxy)ethyloxy] salicylic acid, 4-[3-(p-tolylsulfonyl)propyloxy]salicylic acid, 5-[p-(2-p-methoxyphenoxyethoxy)cumyl]salicylic acid and like aromatic carboxylic acids, as well as salts of these aromatic carboxylic acids with polyvalent metals such as zinc, magnesium, aluminum, calcium, titanium, manganese, tin, nickel and the like; antipyrin complex of zinc thiocyanate, composite zinc salts of terephthalaldehydic acid with another aromatic carboxylic acid, and like organic acidic materials.

When a developer other than 4-allyloxy-4'-hydroxydiphenylsulfone is used, the amount of the developer used can be selected from a broad range; but typically, it is preferable from about 0.01 to about 1 mass part, and more preferably from about 0.05 to about 0.5 mass part, per mass part of 4-allyloxy-4'-hydroxydiphenylsulfone.

Basic Dye

The colorless or pale-colored basic dye for use in the heat-sensitive recording layer may be any of various known colorless or pale-colored basic dyes. Specific examples include blue color forming dyes such as 3,3-bis(p-dimethylaminophenyl)-6-dimethylaminophthalide, 3-(4-diethylamino-2-methylphenyl)-3-(4-dimethylaminophenyl)-6-dimethylaminophthalide, fluoran, etc.;
green color forming dyes such as 3-(N-ethyl-N-p-tolyl) amino-7-N-methylanilinofluoran, 3-diethylamino-7-anilinofluoran, 3-diethylamino-7-dibenzylaminofluoran, etc.;
red color forming dyes such as 3,6-bis(diethylamino)fluoran-γ-anilinolactam, 3-cyclohexylamino-6-chlorofluoran, 3-diethylamino-6-methyl-7-chlorofluoran, 3-diethylamino-7-chlorofluoran, etc.; black color forming dyes such as 3-(N-ethyl-N-isoamyl)amino-6-methyl-7-anilinofluoran,
3-(N-methyl-N-cyclohexyl)amino-6-methyl-7-anilinofluoran,
3-diethylamino-6-methyl-7-anilinofluoran,
3-di(n-butyl)amino-6-methyl-7-anilinofluoran,
3-di(n-pentyl)amino-6-methyl-7-anilinofluoran,
3-diethylamino-7-(o-chlorophenylamino)fluoran,
3-(N-ethyl-p-toluidino)-6-methyl-7-anilinofluoran,
3-(N-ethyl-p-toluidino)-6-methyl-7-(p-toluidino)fluoran,
3-(N-ethyl-N-tetrahydrofurfurylamino)-6-methyl-7-anilinofluoran,
3-diethylamino-6-chloro-7-anilinofluoran,
3-dimethylamino-6-methyl-7-anilinofluoran,
3-pyrrolidino-6-methyl-7-anilinofluoran,
3-piperidino-6-methyl-7-anilinofluoran,
2,2-bis{4-[6'-(N-cyclohexyl-N-methylamino)-3'-methylspiro[phthalide-3,9'-xanthene-2'-ylamino] phenyl}propane,
3-diethylamino-7-(3'-trifluoromethylphenyl)aminofluoran, etc; and
dyes having absorption wavelengths in the near-infrared region, such as 3,3-bis[1-(4-methoxyphenyl)-1-(4-dimethylaminophenyl)ethylene-2-yl]-4,5,6,7-tetrachlorophthalide,
3,3-bis[1-(4-methoxyphenyl)-1-(4-pyrrolidinophenyl)ethylene-2-yl]-4,5,6,7-tetrachlorophthalide,
3-p-(p-dimethylaminoanilino)anilino-6-methyl-7-chlorofluoran,
3-p-(p-chloroanilino)anilino-6-methyl-7-chlorofluoran,
3,6-bis(dimethylamino)fluorene-9-spiro-3'-(6'-dimethylamino)phthalide, etc.

These examples are by no means intended to limit the basic dye for use in the invention, and may also be used in combination, as necessary.

The proportion of the compound represented by general formula (I), developer and basic dye relative to total solids of the heat-sensitive recording layer may suitably be selected from broad ranges; but typically, based on the total solids of the heat-sensitive recording layer, the proportion of the compound represented by general formula (I) is preferably from about 1 to about 40 mass %, and particularly from about 3 to about 30 mass %; the proportion of the developer (i.e., 4-allyloxy-4'-hydroxydiphenylsulfone and optional developer(s) is preferably from about 10 to about 70 mass %, and more preferably from about 12 to about 50 mass %; and the proportion of the basic dye is preferably from about 3 to about 50 mass %, and more preferably from about 5 to about 40 mass %.

Binder

A heat-sensitive recording layer coating composition typically comprises any of various resins as a binder. At least one of the following examples is used as a binder: starches, hydroxyethyl cellulose, methyl cellulose, carboxymethyl cellulose, gelatin, casein, gum arabic, polyvinyl alcohols, carboxy-modified polyvinyl alcohols, acetoacetyl group-modified polyvinyl alcohols, silicon-modified polyvinyl alcohols, diisobutylene-maleic anhydride copolymer salts, styrene-maleic anhydride copolymer salts, ethylene-acrylic acid copolymer salts, styrene-acrylic acid copolymer salts, styrene-butadiene copolymer emulsions, urea resins, melamine resins, amide resins, polyurethane resins and the like. The proportion of the resin to total solids of the heat-sensitive recording layer is from about 5 to about 50 mass %, and preferably from about 10 to about 40 mass %.

Other Components

In the heat-sensitive recording material of the invention, the heat-sensitive recording layer may further comprise a sensitizer, a preservability improving agent and other various auxiliaries, in addition to the compound represented by general formula (I), developer, basic dye and binder.

<Sensitizer>

The heat-sensitive recording layer of the invention may further comprise a sensitizer. Examples of sensitizers include stearic acid amide, methoxycarbonyl-N-stearic acid benzamide, N-benzoyl stearamide, N-eicosanoic acid amide, ethylene bis stearamide, behenic acid amide, methylene bis stearamide, N-methylol stearamide, dibenzyl terephthate, dimethyl terephthalate, dioctyl terephthate, benzyl p-benzyloxy benzoate, phenyl 1-hydroxy-2-naphthoate, 2-naphthyl benzyl ether, m-terphenyl, p-benzyl biphenyl, di-p-chlorobenzyl oxalate, di-p-methylbenzyl oxalate, p-tolylbiphenyl ether, di(p-methoxyphenoxyethyl)ether, 1,2-di(3-methylphenoxy)ethane, 1,2-di(4-methylphenoxy)ethane, 1,2-di(4-methoxyphenoxy)ethane, 1,2-di(4-chlorophenoxy) ethane, 1,2-diphenoxyethane, 1-(4-methoxyphenoxy)-2-(3-methylphenoxy)ethane, p-methylthiophenylbenzyl ether, 1,4-di(phenylthio)butane, p-acetotoluidide, p-acetophenetidide, N-acetoacetyl-p-toluidine, di(β-biphenylethoxy)benzene, p-di(vinyloxyethoxy)benzene, 1-isopropylphenyl-2-phenylethane and the like. Such sensitizers can be used in combination as long as the effects of the invention are not impaired.

When a sensitizer is used, the sensitizer may be used in an effective amount for sensitization. Typically, the proportion of the sensitizer to total solids of the heat-sensitive recording layer is preferably from about 2 to about 40 mass %, and more preferably from about 5 to about 25 mass %.

<Preservability Improving Agent>

The heat-sensitive recording layer of the invention may further comprise a preservability improving agent. Examples of preservability-improving agents include 2,2'-methylene bis(4-methyl-6-tert-butylphenol), 2,2'-methylene bis(4-ethyl-6-tert-butylphenol), 2,2'-ethylidene bis(4,6-di-tert-butylphenol), 4,4'-thiobis(2-methyl-6-tert-butylphenol), 4,4'-butylidene bis(6-tert-butyl-m-cresol), 1-[α-methyl-α-(4'-hydroxyphenyl)ethyl]-4-[α',α'-bis(4'-hydroxyphenyl)ethyl]benzene, 1,1,3-tris(2-methyl-4-hydroxy-5-cyclohexylphenyl)butane, 1,1,3-tris(2-methyl-4-hydroxy-5-tert-butylphenyl)butane, 4,4'-thiobis(3-methylphenol), 4,4'-dihydroxy-3,3',5,5'-tetrabromodiphenylsulfone, 4,4'-dihydroxy-3,3',5,5'-tetramethyldiphenylsulfone, 2,2-bis(4-hydroxy-3,5-dibromophenyl)propane, 2,2-bis(4-hydroxy-3,5-dichlorophenyl)propane, 2,2-bis(4-hydroxy-3,5-dimethylphenyl)propane and like hindered phenol compounds; 1,4-diglycidyloxybenzene, 4,4'-diglycidyloxydiphenylsulfone, 4-benzyloxy-4'-(2-methylglycidyloxy)diphenylsulfone, diglycidyl terephthalate, cresol novolac epoxy resins, phenol novolac epoxy resins, Bisphenol A type epoxy resins and like epoxy compounds;

N,N'-di-2-naphthyl-p-phenylenediamine, salts of sodium or polyvalent metal of 2,2'-methylene bis(4,6-di-tert-buthylphenyl)phosphate, bis(4-ethyleneiminocarbonylaminophenyl)methane, etc.

When a preservability improving agent is used, the preservability-improving agent may be used in an effective amount to improve the preservability. Typically, the proportion of the preservability-improving agent to total solids of the heat-sensitive recording layer is preferably from about 1 to about 30 mass %, and more preferably from about 5 to about 20 mass %.

Heat-Sensitive Recording Layer Coating Composition

The heat-sensitive recording layer coating composition comprising the aforementioned various components may be prepared by dispersing together or separately a dye, a developer, a specific compound for use in the invention, a sensitizer and the like in a dispersion medium, typically water, using an agitator or grinder such as a ball mill, attritor or sand mill.

The heat-sensitive recording layer coating composition may additionally comprise various auxiliaries, as necessary. Examples of suitable auxiliaries include sodium dioctyl sulfosuccinate, sodium dodecylbenzene sulphonate, sodium lauryl sulfate, metal salts of fatty-acid and like dispersing agents; zinc stearate, calcium stearate, polyethylene wax, carnauba wax, paraffin wax, ester wax and like waxes; antifoaming agents; coloring dyes; pigments; and the like. Examples of pigments include kaolin, clay, calcium carbonate, calcined clay, calcined kaolin, titanium oxide, aluminium hydroxide, diatomite, powdered anhydrous silica, activated clay and like inorganic pigments; styrene microballs, nylon powder, polyethylene powder, urea-formalin resin fillers, raw starch particles and like organic pigments; and the like.

Undercoat Layer

In accordance with the invention, an undercoat layer may optionally be provided between the support and the heat-sensitive recording layer for further improving the recording sensitivity and recording runnability. The undercoat layer can be formed by applying over the support an undercoat layer coating composition that principally comprises a binder and/or organic hollow particles and/or thermal expansion particles and/or oil-absorbing pigments having an oil absorption of 70 ml/100 g or more, and preferably from about 80 to about 150 ml/100 g, and then drying the coating composition. The oil absorption is herein determined in accordance with JIS K 5101.

While a variety of oil-absorbing pigments are usable, specific examples include inorganic pigments such as calcined kaolin, amorphous silica, light calcium carbonate, talc and the like. Such oil-absorbing pigments preferably have an average primary particle diameter of about 0.01 to about 5 μm, and more preferably about 0.02 to about 3 μm. The amount of the oil-absorbing pigment used can be selected from a broad range, but is typically from about 2 to about 95 mass %, and preferably from about 5 to about 90 mass %, of total solids of the undercoat layer.

Known organic hollow particles are usable, and examples include particles having shells of, e.g., acrylic resin, styrene resin, vinylidene chloride resin, and having a void ratio of from about 50 to about 99%. The void ratio is herein determined by $(d/D)\times 100$, where d represents the inside diameter of, and D represents the outside diameter of, organic hollow particles. The organic hollow particles preferably have an average particle diameter of about 0.5 to about 10 μm, and more preferably about 1 to about 3 μm. The amount of organic hollow particles used can be selected from a broad range, but is typically from about 2 to about 90 mass %, and preferably from about 5 to about 70 mass %, of total solids of the undercoat layer.

When an oil-absorbing inorganic pigment as specified above is used together with organic hollow particles, the pigment and particles are each preferably used in the aforementioned range. The total content of the pigment and particles is preferably from about 5 to about 90 mass %, and more preferably from about 10 to about 80 mass %, of total solids of the undercoat layer.

Examples of preferable binders include the above-exemplified binders for use in the heat-sensitive recording layer. Among these examples, starch-vinyl acetate graft copolymers, polyvinyl alcohols and styrene-butadiene copolymer latexes are especially preferable.

The amount of the binder used can be selected from a broad range, but is typically preferably from about 5 to about 30 mass %, and particularly from about 10 to about 20 mass %, of total solids of the undercoat layer.

Protective Layer

The heat-sensitive recording material of the invention preferably comprises a protective layer on a recording layer in order to improve the recorded-image preservability against chemicals such as plasticizers, oils and the like, or improve the recording suitability.

A protective layer coating composition may be prepared by any suitable process. For example, the protective layer coating composition may be prepared by mixing binder(s), such as starches, hydroxyethyl cellulose, methyl cellulose, carboxymethylcellulose, gelatin, casein, gum arabic, polyvinyl alcohols, carboxy-modified polyvinyl alcohols, acetoacetyl group-modified polyvinyl alcohols, silicon-modified polyvinyl alcohols and the like, with optional pigment(s) such as kaolin, light calcium carbonate, particulate silica and the like; and then stirring the mixture in a dispersion medium of, typically, water.

The protective layer can also be formed using the above binder and optionally at least one of the auxiliaries mentioned below, without using pigments.

Alternatively, the protective layer can be formed using a binder and a pigment. In this case, the amount of the binder used is not limited, and can be selected from a broad range, but is typically from about 1 to about 95 mass %, and preferably from about 2 to about 80 mass %, based on total solids of the protective layer. The amount of the pigment is also not limited, and can be selected from a broad range, but is typically from about 1 to about 95 mass %, and more preferably from about 2 to about 90 mass %, based on total solids of the protective layer.

The protective layer coating composition may further comprise various auxiliaries as necessary. Examples of such auxiliaries include zinc stearate, calcium stearate, polyethylene wax, carnauba wax, paraffin wax, ester wax and like lubricants; sodium dioctyl sulfosuccinate and like surfactants (such as dispersing agents and wetting agents); anti-foaming agents; potassium alum, aluminium acetate and like water-soluble polyvalent metal salts; and the like. In order to further improve the water resistance, a curing agent such as glyoxal, boric acid, dialdehyde starch, an epoxy compound or the like may be used conjointly.

Particularly when a microcapsule encapsulating an ultraviolet absorbent that is liquid at ordinary temperatures, such as 2-(2'-hydroxy-3'-dodecyl-5'-methylphenyl)benzotriazole, is added into the protective layer in such an amount that the proportion of the ultraviolet light absorber is from about 10 to about 40 mass %, and preferably from about 15 to about 38 mass %, based on total solids of the protective layer, the background yellowing and color fading of recorded images due to exposure to light significantly decrease.

Support

The support may be suitably selected from papers, plastic films, synthetic papers, non-woven fabrics, metal deposited materials and the like.

The use of base stock containing recycled fiber as a support has previously tended to result in poor preservability; however, satisfactory preservability can be attained in accordance with the invention, even when such base stock containing recycled fiber is used as a support. More specifically, the heat-sensitive recording material, even when using base stock containing recycled fiber as a support, has excellent recorded-image preservability against chemicals such as oils and the like. Moreover, the heat-sensitive recording material, even when recording after a long period of storage in an unrecorded state, gives a color density almost the same as that initially obtained (i.e., the color density of a heat-sensitive recording material obtained immediately often preparation).

Heat-Sensitive Recording Material According to the Invention

The undercoat layer, heat-sensitive recording layer and protective layer may be formed by any suitable process. For example, by using a suitable technique such as air-knife coating, vari-bar blade coating, pure blade coating, rod blade coating, short-dwell coating, curtain coating, die coating or the like, an undercoat layer coating composition may be applied to the support and then dried, and subsequently to the undercoat layer, a heat-sensitive recording layer coating composition, followed by the protective layer coating composition, may be applied and dried.

When an undercoat layer is formed, the undercoat layer coating composition is applied in an amount of about 3 to about 20 g/m$^2$, and preferably about 5 to about 12 g/m$^2$, on a dry weight basis. The heat-sensitive recording layer coating composition is applied in an amount of about 2 to about 12 g/m$^2$, and preferably from about 3 to about 10 g/m$^2$, on a dry weight basis. When a protective layer is formed, the protective layer coating composition is applied in an amount of about 0.5 to about 15 g/m$^2$, and preferably from about 1.0 to about 8 g/m$^2$, on a dry weight basis.

Optionally, a protective layer can also be formed on the back surface of the heat-sensitive recording material to further improve the preservability or to give a high gloss. Various techniques known in the art of making heat-sensitive recording materials are applicable, as necessary, to the present invention. For example, all of the layers that have been formed may undergo a smoothing treatment such as super-calendering; an adhesive may be applied to the back surface of the heat-sensitive recording material to make the material into an adhesive label; the heat-sensitive recording material may additionally comprise a magnetic recording layer, a printing coating layer and/or a thermal transfer recording layer; and so forth.

EXAMPLES

The present invention will hereinafter be described in greater detail by way of Preparation Examples showing the preparation of the compounds represented by formulae (II) and (III), Examples and Comparative Examples; however, the invention is not limited to these Examples. In the following examples, "parts" and "%" represent "parts by mass" and "percent by mass", respectively, unless otherwise specified.

Preparation Example 1

Preparation of Compound Represented by Formula (II)

The compound of Formula (II) can be synthesized, for example, according to the process described in the Examples of Japanese Patent Application No. 2004-242569. One exemplary process for preparing the compound is described below.

(1) Synthesis of Starting Material 1,5-(3-Oxapentamethylene)bis(3-aminobenzoate)

In a three-necked flask equipped with a thermometer, a reflux tube and a dropping funnel were placed 9.84 g of 3-aminobenzoic acid and 120 ml of N,N-dimethyl formamide (dehydrated). To the resulting solution, 9.96 g of potassium carbonate (anhydrous) was added. To this mixture was added 5.16 g of bis(2-chloroethyl)ether at room temperature while stirring with a magnetic stirrer. The resulting suspension was stirred at room temperature for a short period (within 10 minutes) and then heated under reflux at 130° C. for 4 hours. After cooling to room temperature, the reaction suspension was added to 300 ml of water and stirred vigorously. The potassium carbonate suspended in the reaction suspension was then dissolved in water, and a white solid precipitated. The white solid precipitated was filtered to afford 10.5 g of 1,5-(3-oxapentamethylene)bis(3-aminobenzoate) in the form of a white solid. The resulting white solid was confirmed to be the desired product (title compound) through analyses performed by various instruments.

(2) Synthesis of Compound Represented by Formula (II)

In a three-necked flask equipped with a dropping funnel, a thermometer and a reflux tube was placed 10.5 g of 1,5-(3-oxapentamethylene)bis(3-aminobenzoate) obtained in Section (1) above, and then 200 ml of acetonitrile was added and the mixture was stirred for dissolution. While stirring the resulting solution with a magnetic stirrer, 13.8 g of p-toluenesulfonyl isocyanate was added dropwise through the dropping funnel at room temperature. Stirring of the reaction mixture was continued, whereby a large amount of a white solid precipitated. The reaction mixture was heated at 80° C. for 4 hours, cooled and filtered to afford 19.5 g of the compound represented by formula (II) in the form of white crystals.

The analysis values of the resulting white crystals were as follows:

Melting point (measured by DSC): 139.8° C.

NMR measurement (in DMSO):

δ (ppm)=2.36 (s, 6H), 3.77 (t, 4H), 4.36 (t, 4H), 7.32 (t, 2H), 7.41 (d, 4H), 7.52-7.54 (m, 4H), 7.83 (d, 4H), 7.98 (t, 2H)

In addition, peaks attributable to N—H appeared near δ=9.07, 10.85 ppm.

Preparation Example 2

Preparation of Compound Represented by Formula (III)

The compound of Formula (III) can be synthesized, for example, according to the process described in the Examples of Japanese Patent Application No. 2004-242569. One exemplary process for preparing the compound is described below.

(1) Synthesis of Starting Material 1,5-Pentamethylene bis(3-aminobenzoate)

In a three-necked flask equipped with a thermometer, a reflux tube and a dropping funnel were placed 8.20 g of 3-aminobenzoic acid and 100 ml of N,N-dimethyl formamide, and then 8.30 g of potassium carbonate (anhydrous) was added to the resulting solution. To the resulting mixture was added 6.85 g of 1,5-dibromopentane at room temperature while stirring with a magnetic stirrer. After stirring at room temperature, the resulting suspension was heated under reflux at 130° C. for 4 hours, and then cooled to room temperature. The reaction suspension was added to 300 ml of water and stirred vigorously. The resulting suspension, in which the potassium carbonate was dissolved in the water, while the desired product was partially dispersed or sedimented, was extracted with 150 ml of ethyl acetate, and then the solvent was distilled off, thus affording 9.75 g of 1,5-pentamethylene bis(3-aminobenzoate) in the form of an oil. The resulting oily product was confirmed to be the desired product, (title compound), through analyses performed by various instruments.

(2) Synthesis of Compound Represented by Formula (III)

In a three-necked flask equipped with a dropping funnel, a thermometer and a reflux tube was placed 9.75 g of 1,5-pentamethylene bis(3-aminobenzoate), and then 200 ml of acetonitrile was added and the mixture was stirred for dissolution. While stirring this solution with a magnetic stirrer, 12.7 g of p-toluenesulfonyl isocyanate was added dropwise through the dropping funnel at room temperature. Stirring of the reaction mixture was continued, whereby a large amount of a white solid precipitated. The reaction mixture was heated at 80° C. for 4 hours, cooled and filtered to afford 19.8 g of the compound represented by formula (III) in the form of white crystals.

The analysis values of the resulting white crystals were as follows:

Melting point: 116 to 124° C.

NMR measurement (in DMSO):

δ (ppm)=1.50 (d, 2H), 1.74 (t, 4H), 2.36 (s, 6H), 4.26 (t, 4H), 7.36 (t, 4H), 7.40 (d, 2H), 7.56 (t, 4H), 7.84 (d, 4H), 7.99 (d, 2H)

In addition, peaks attributable to N—H appeared near δ=9.08, 10.74 ppm.

Example 1

Preparation of Undercoat Layer Coating Composition

A composition comprising 40 parts of calcined clay (trade name: Ansilex, manufactured by ENGELHARD MINERALS & CHEMICALS CORPORATION, oil absorption: 110 ml/100 g); 100 parts of a 40% dispersion of organic hollow particles with an average particle diameter of 1.0 μm (inside/outside diameter ratio=0.7, shell material: polystyrene); 1 part of a 40% aqueous solution of sodium polyacrylate; 14 parts of a styrene-butadiene latex with a solids concentration of 48%; 50 parts of a 10% aqueous solution of a polyvinyl alcohol (saponification degree: 88%, polymerization degree: 1000); and 40 parts of water was mixed and stirred to give an undercoat layer coating composition.

Preparation of Dispersion A

A composition comprising 10 parts of 3-di(n-butyl)amino-6-methyl-7-anilinofluoran, 5 parts of a 5% aqueous solution of methylcellulose and 40 parts of water was pulverized with a sand mill to an average particle diameter of 0.5 μm.

Preparation of Dispersion B

A composition comprising 20 parts of 4-allyloxy-4'-hydroxydiphenylsulfone (trade name: BIS-MAE, manufactured by Nicca Chemical Co., Ltd.), 20 parts of a 10% aqueous solution of a polyvinyl alcohol (trade name: GOHSELAN L-3266, manufactured by Nippon Synthetic Chemical Industry Co., Ltd.) and 10 parts of water was dispersed with a vertical sand mill (manufactured by Imex Corporation) to a particle diameter of 1 μm.

Preparation of Dispersion C

A composition comprising 20 parts of the compound represented by Formula (II) shown below, 20 parts of a 10% aqueous solution of a polyvinyl alcohol (trade name: GOHSELAN L-3266, manufactured by Nippon Synthetic Chemical Industry Co., Ltd.) and 30 parts of water was dispersed with a vertical sand mill (manufactured by Imex Corporation) to a particle diameter of 1 μm.

[Chemical formula 11]

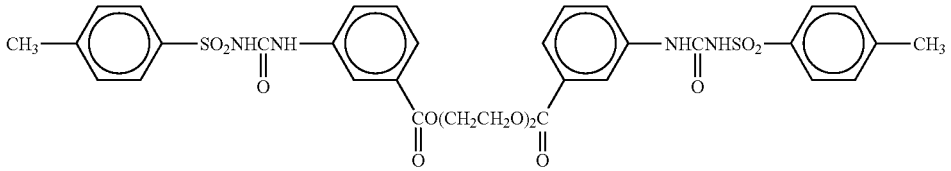

(II)

Preparation of Dispersion D

A composition comprising 10 parts of di-p-methylbenzyl oxalate (trade name: HS-3520, manufactured by Dainippon Ink and Chemicals, Inc.); 10 parts of di-p-chlorobenzyl oxalate (trade name: HS-3519, manufactured by Dainippon Ink and Chemicals, Inc.); 20 parts of a 10% aqueous solution of a polyvinyl alcohol (trade name: GOHSELAN L-3266, manufactured by Nippon Synthetic Chemical Industry Co., Ltd.); and 10 parts of water was dispersed with a vertical sand mill (manufactured by Imex Corporation) to a particle diameter of 1 μm.

Preparation of Heat-Sensitive Recording Layer Coating Composition

A heat-sensitive recording layer coating composition was prepared by mixing 60 parts of Dispersion A, 50 parts of Dispersion B, 35 parts of Dispersion C, 40 parts of Dispersion D, 170 parts of a 10% aqueous solution of a polyvinyl alcohol, 12 parts of a 36% zinc stearate dispersion (trade name: HIDORIN Z-8, manufactured by Chukyo Yushi Co., Ltd.) and 50 parts of a 60% calcium carbonate dispersion (trade name: Brilliant 15, manufactured by Shiraishi Kogyo Kaisha, Ltd.), and then stirring the mixture.

Preparation of Heat-Sensitive Recording Material

The undercoat layer coating composition was applied to one side of a 44 g/m$^2$ 50% base stock containing recycled fiber in an amount of 7 g/m$^2$ on a dry weight basis and dried. The heat-sensitive recording layer coating composition was then applied over the undercoat layer in an amount of 5 g/m$^2$ on a dry weight basis and dried. The resulting material was then supercalendered to give a heat-sensitive recording material.

Example 2

A heat-sensitive recording material was prepared in the same manner as in Example 1, except that in preparing Dispersion C, the compound represented by formula (III) shown below was used instead of the compound represented by formula (II).

[Chemical formula 12]

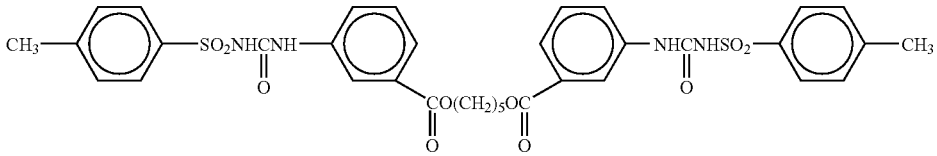

(III)

Example 3

A heat-sensitive recording material was prepared in the same manner as in Example 1, except that in preparing Dispersion C, the compound represented by formula (IV) shown below was used instead of the compound represented by formula (II).

[Chemical formula 13]

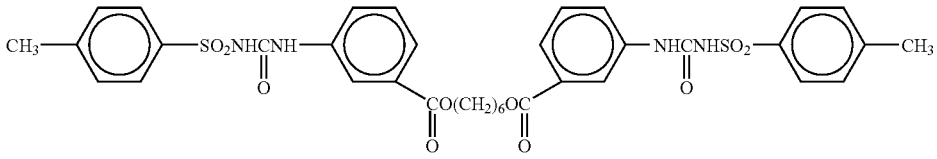

(IV)

Example 4

(a) Preparation of Protective Layer Coating Composition

A composition comprising 200 parts of a 12% aqueous solution of acetoacetyl-modified polyvinyl alcohol (trade name: "GOHSEFIMER Z-200", manufactured by Nippon Synthetic Chemical Industry Co., Ltd.); 60 parts of kaolin (trade name: Ultra White 90, manufactured by ENGELHARD); 30 parts of a 30% zinc stearate dispersion (trade name: HIDORIN Z-7-30, manufactured by Chukyo Yushi Co., Ltd.); 2 parts of a polyamide epichlorohydrin resin-based crosslinking agent (PA-801, manufactured by Japan PMC); and 210 parts of water was mixed and stirred to give a protective layer coating composition.

(b) Preparation of Heat-Sensitive Recording Material

A heat-sensitive recording material was prepared as in Example 1, except that the protective layer coating composition obtained in Section (a) above was applied in an amount of 3 g/m$^2$ over the heat-sensitive recording layer of the heat-sensitive recording material obtained in Example 1.

Comparative Example 1

A heat-sensitive recording material was prepared in the same manner as in Example 1, except that Dispersion C was not used.

Comparative Example 2

A heat-sensitive recording material was prepared in the same manner as in Example 1, except that in preparing Dispersion C, 2,2'-[4-(4-(hydroxyphenylsulfonyl)phenoxy]diethyl ether (trade name: D-90, manufactured by Nippon Soda Co., Ltd.) was used instead of the compound represented by formula (II).

Comparative Example 3

A heat-sensitive recording material was prepared in the same manner as in Example 1, except that in preparing Dispersion C, 1,1,3-tris(2-methyl-4-hydroxy-5-cyclohexylphenyl)butane (trade name: DH-43, manufactured by Adeka Corporation) was used instead of the compound represented by formula (II).

Comparative Example 4

A heat-sensitive recording material was prepared in the same manner as in Example 1, except that in preparing Dispersion B, 4-hydroxy-4'-isopropoxydiphenylsulfone (trade name: D-8, manufactured by Nippon Soda Co., Ltd.) was used instead of 4-allyloxy-4'-hydroxydiphenylsulfone.

Comparative Example 5

A heat-sensitive recording material was prepared in the manner as in Example 1, except that Dispersion B was not used, and the amount of dispersion C was changed from 35 parts to 105 parts, in preparing a heat-sensitive recording layer coating composition according to Example 1.

The heat-sensitive recording materials thus obtained were tested for the following characteristics. The results are shown in Table 1.

[Dynamic Sensitivity]

Each heat-sensitive recording material was subjected to color development at an applied energy of 0.34 mJ/dot using a thermal recording tester (trade name: "TH-PMD", manufactured by OKURA DENKI) to record an 8×8 mm image. The density of the recorded portion was measured with a Macbeth densitometer (trade name: "RD-914", manufactured by Macbeth) in visual mode.

[Thermal Resistance]

Each heat-sensitive recording material recorded in the dynamic sensitivity test was left to stand at 90° C. for 24 hours, and then the densities of the background and recorded portion were measured with a Macbeth densitometer (trade name: "RD-914", manufactured by Macbeth) in visual mode, to evaluate the thermal resistance.

[Oil Resistance]

A salad oil was applied to each heat-sensitive recording material recorded in the dynamic sensitivity test, and then left to stand at 20° C. for 24 hours. The density of the recorded portion was measured with a Macbeth densitometer (trade name: "RD-914", manufactured by Macbeth) in visual mode, to evaluate the oil resistance.

TABLE 1

| | Dynamic | Thermal resistance | | Oil |
|---|---|---|---|---|
| | Sensitivity | Background | Recorded portion | resistance |
| Ex. 1 | 1.38 | 0.16 | 1.37 | 1.25 |
| Ex. 2 | 1.39 | 0.17 | 1.35 | 1.22 |
| Ex. 3 | 1.37 | 0.18 | 1.35 | 1.28 |
| Ex. 4 | 1.48 | 0.17 | 1.45 | 1.45 |
| Comp. Ex. 1 | 1.32 | 0.09 | 0.78 | 0.32 |
| Comp. Ex. 2 | 1.32 | 0.35 | 1.28 | 1.12 |
| Comp. Ex. 3 | 1.34 | 0.18 | 1.34 | 0.48 |
| Comp. Ex. 4 | 1.35 | 0.65 | 1.32 | 1.34 |
| Comp. Ex. 5 | 1.20 | 0.15 | 1.15 | 1.15 |

The invention claimed is:

1. A heat-sensitive recording material comprising a support and a heat-sensitive recording layer; the heat-sensitive recording layer comprising a colorless or pale-colored basic dye, a developer and a binder;

the developer being 4-allyloxy-4'-hydroxydiphenylsulfone; and the heat-sensitive recording layer further comprising a compound represented by formula (I):

[Chemical formula 1]

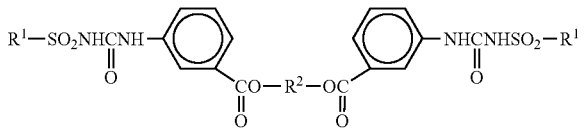

(I)

wherein $R^1$ is an unsubstituted aromatic group, or an aromatic group substituted with at least one member selected from the group consisting of methyl groups and a chlorine atom, and $R^2$ is a divalent organic group.

2. A heat-sensitive recording material according to claim 1, wherein $R^1$ is unsubstituted phenyl or unsubstituted naphthyl, or phenyl or naphthyl substituted with one or two members selected from the group consisting of a methyl group and a chlorine atom; and $R^2$ is (a): a straight $C_{1-30}$ alkylene group, a branched $C_{1-30}$ alkylene group, a $C_{6-16}$ cycloalkylene group, or a $C_{1-4}$ alkylene, group containing said cycloalkylene group within the structure; or (b): a group represented by the formula —$(CH_2CH_2X)n$-$CH_2CH_2$— (where X is an oxygen or sulfur atom, and n is an integer from 1 to 20), 2,5-(1-oxacyclohexylene) group, or 1-oxacyclohexane-2,5-dimethylene group.

3. A heat-sensitive recording material according to claim 1, wherein $R^2$ is a —$(CH_2)m$- group or a —$(CH_2CH_2O)n$-$CH_2CH_2$— group, where m is an integer from 1 to 30, and n is an integer from 1 to 20.

4. A heat-sensitive recording material according to claim 1, wherein the compound represented by formula (I) is a compound represented by formula (II):

[Chemical formula 2]

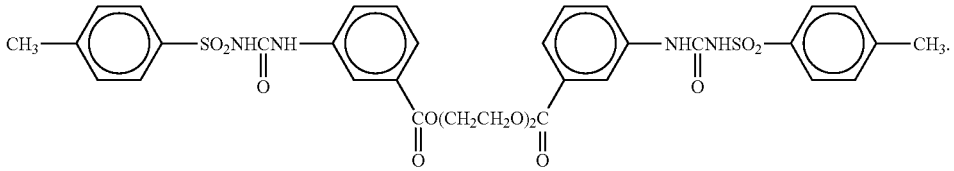

(II)

5. A heat-sensitive recording material according to claim 1, wherein the compound represented by formula (I) is a compound represented by formula (III):

[Chemical formula 3]

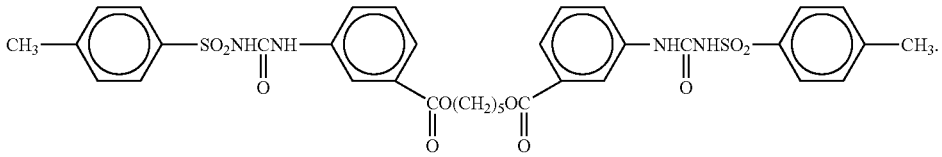

(III)

6. A heat-sensitive recording material according to claim 1, wherein the compound represented by formula (I) is a compound represented by formula (IV):

[Chemical formula 4]

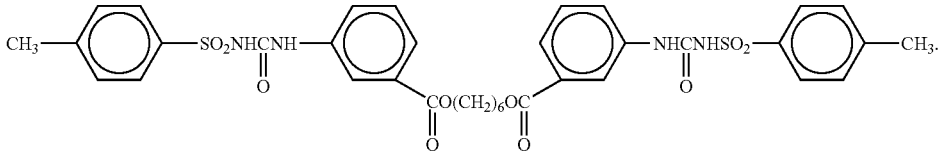

(IV)

7. A heat-sensitive recording material according to claim 1, wherein the heat-sensitive recording layer further comprises an inorganic acidic material, a phenolic compound, a thiourea compound, an organic compound having an —$SO_2NH$— bond in the molecular, an aromatic carboxylic acid, a polyvalent metal salt of an aromatic carboxylic acid, an antipyrin complex of zinc thiocyanate, a composite zinc salt of terephthalaldehydic acid with another aromatic carboxylic acid, or a mixture thereof.

8. A heat-sensitive recording material according to claim 1, wherein the heat-sensitive recording layer further comprises a sensitizer, a preservability improving agent, or a mixture thereof.

9. A heat-sensitive recording material according to claim 1, further comprising a protective layer on the heat-sensitive recording layer.

10. A heat-sensitive recording material according to claim 9, wherein the protective layer comprises a binder, or a binder and a pigment.

11. A heat-sensitive recording material according to claim 10, wherein the protective layer further comprises a microcapsule encapsulating an ultraviolet absorbent that is liquid at ordinary temperatures; the microcapsules being present in such an amount that the proportion of the ultraviolet light absorber is from 10 to 40 mass % relative to total solids of, the protective layer.

12. A heat-sensitive recording material according to claim 1, wherein the support comprises recycled pulp.

13. A heat-sensitive recording material according to claim 1, further comprising an undercoat layer between the support and the heat-sensitive recording layer.

* * * * *